US008714604B1

(12) United States Patent
Mihalic

(10) Patent No.: US 8,714,604 B1
(45) Date of Patent: May 6, 2014

(54) SANITARY PET FECES RETRIEVAL SYSTEM

(71) Applicant: Tammy Mihalic, Ormond Beach, FL (US)

(72) Inventor: Tammy Mihalic, Ormond Beach, FL (US)

( * ) Notice: Subject to any disclaimer, the term of this patent is extended or adjusted under 35 U.S.C. 154(b) by 0 days.

(21) Appl. No.: 13/938,970

(22) Filed: Jul. 10, 2013

(51) Int. Cl.
*A01K 29/00* (2006.01)

(52) U.S. Cl.
USPC ..... 294/1.4

(58) Field of Classification Search
USPC ..... 294/1.3–1.5, 209, 50.8, 176, 115; 15/104.8, 257.1, 257.2, 257.6; 119/161, 867, 858; 383/33–34, 34.1
See application file for complete search history.

(56) References Cited

U.S. PATENT DOCUMENTS 3,733,098 A * 5/1973 Tobias ..... 294/1.4
3,738,697 A * 6/1973 Kahan ..... 294/1.4
4,225,174 A * 9/1980 Hennessy et al. ..... 294/1.4
D263,512 S 3/1982 Kawada
4,878,703 A 11/1989 Yoshioka
5,326,143 A * 7/1994 Babler ..... 294/1.4
5,503,442 A 4/1996 Lee
7,523,972 B1 * 4/2009 Wawrzynowski ..... 294/1.3
7,854,455 B2 12/2010 Ruscil et al.
7,992,907 B1 8/2011 DeJesus
2008/0265592 A1 10/2008 Askinasi
2011/0057464 A1 3/2011 Jones, Jr.
2011/0272955 A1 11/2011 Zidulka et al.
2012/0104780 A1 5/2012 Lloyd et al.

* cited by examiner

*Primary Examiner* — Stephen Vu

(57) ABSTRACT

A sanitary pet feces retrieval system having a disposable liner features a feces scoop having an elongated handle with a first scooping jaw and a mated, opposing second scooping jaw pivotally located on a handle second end. A lever pivots the first scooping jaw away from the second scooping jaw into an open position for retrieving feces from a ground surface. The system features a bag dispenser located on the handle. Disposable bags are sequentially located on a bag roll. A bag fully covers a scoop inner surface and wraps around to fully cover a first jaw outer surface and a second jaw outer surface. A bag upper lip is located at a first jaw posterior opening and a second jaw posterior opening via attachment to a plurality of jaw eyelets located on a jaw posterior lip.

5 Claims, 5 Drawing Sheets

SANITARY PET FECES RETRIEVAL SYSTEM

FIELD OF THE INVENTION

The present invention relates to debris removal systems, or more specifically, feces removal systems with disposable continuous feed through bags.

BACKGROUND OF THE INVENTION

Walking pets is a practice that is widely popular, however, the pet may encounter a need to defecate while on the walk. In some neighborhoods or cities, there are ordinances against leaving pet feces laying on a sidewalk or in a yard. In some instances, it may be considered rude to leave pet feces laying on a sidewalk or in a yard. The present invention features a sanitary pet feces retrieval system having a disposable liner Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a sanitary pet feces retrieval system having a disposable liner. In some embodiments, the system comprises a feces scoop having an elongated handle, a first scooping jaw pivotally located on a handle second end, and a mated and opposing second scooping jaw pivotally located on the handle second end.

In some embodiments, the first scooping jaw and the second scooping jaw comprise a cupped shape. In some embodiments, a first jaw anterior lip interfaces with a second jaw anterior lip in a first closed position to form a semi-cylindrical scoop inner surface to carry feces. In some embodiments, a lever pivots the first scooping jaw away from the second scooping jaw into a second open position for retrieving feces from a ground surface.

In some embodiments, the system comprises a bag dispenser located on the handle. In some embodiments, the system comprises, a disposable continuous feed through bag having an opening and an upper lip located around the opening. In some embodiments, the continuous feed through bag is sequentially located on a bag roll. In some embodiments, the continuous feed through bag fully covers the scoop inner surface and wraps around and fully covers a first jaw outer surface and a second jaw outer surface. In some embodiments, the bag upper lip is located at a first jaw posterior opening and a second jaw posterior opening via attachment to a plurality of jaw eyelets located on a jaw posterior lip.

DESCRIPTION OF PREFERRED EMBODIMENTS

Figure 1:
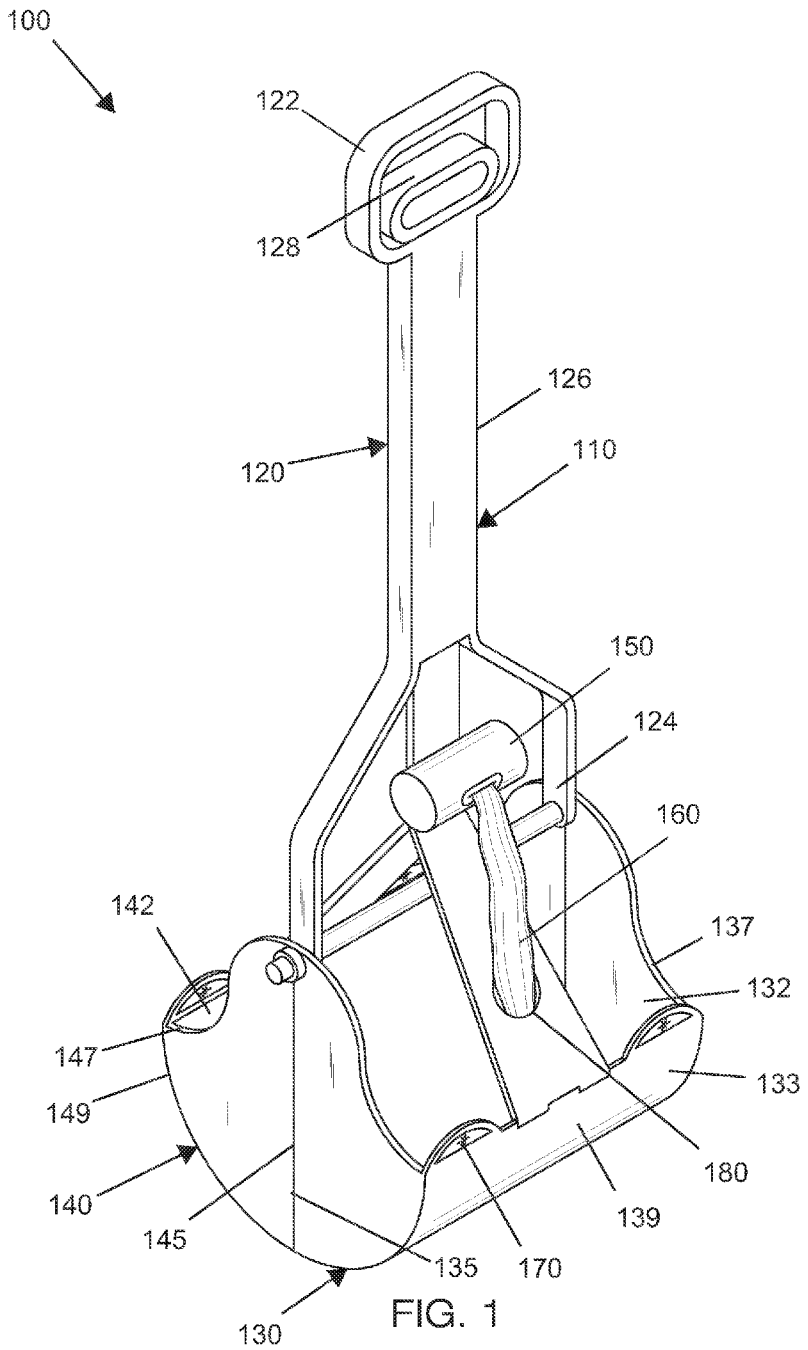
FIG. 1 shows a perspective view of the present invention.
Figure 3:
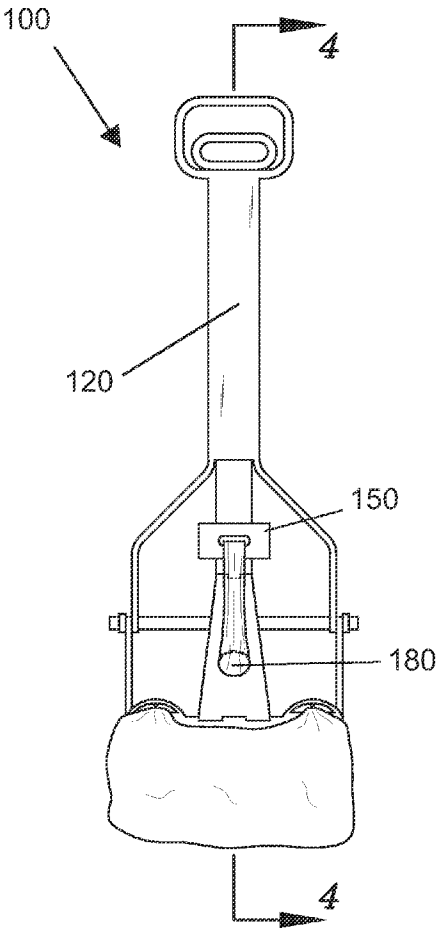
FIG. 3 shows a front view of the present invention.
Figure 2:
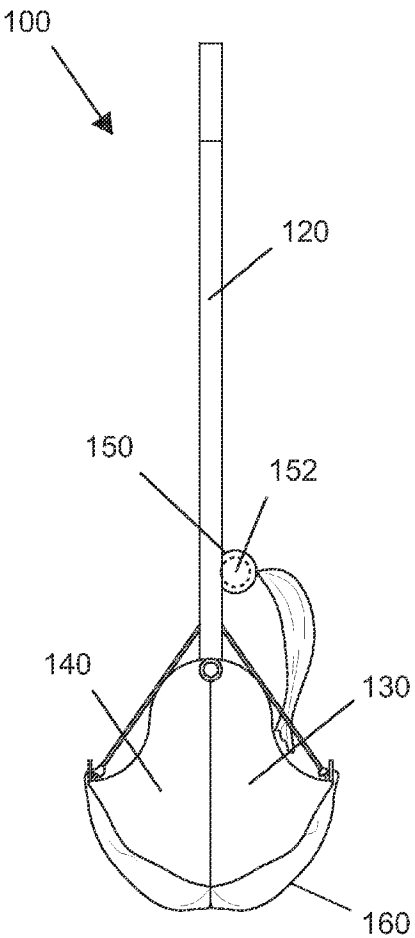
FIG. 2 shows a side view of the present invention.
Figure 4B:
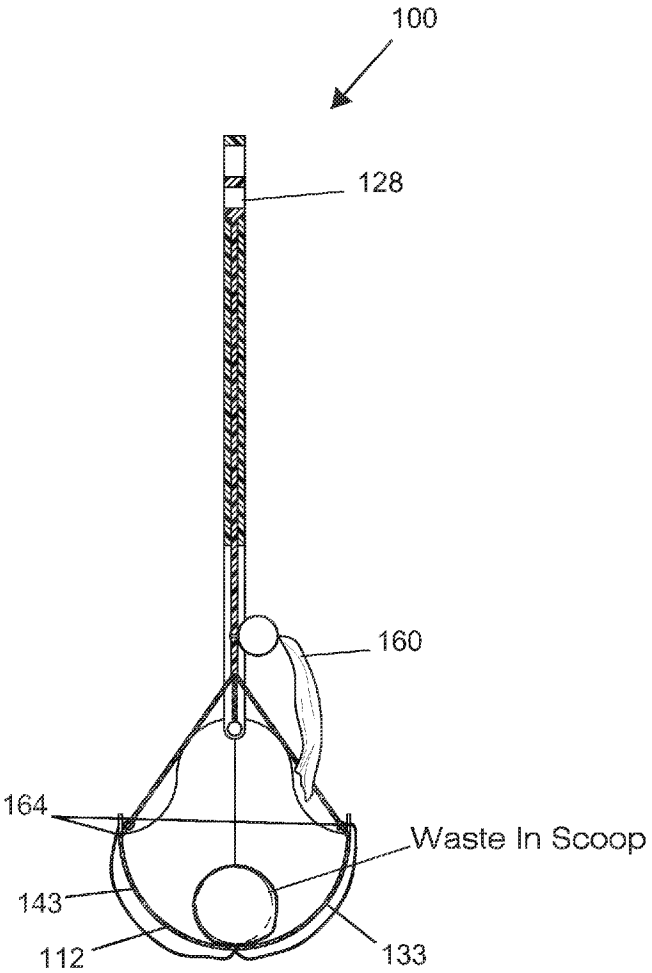
FIG. 4*b* shows a cross-sectional view of the present invention in a sagittal plane in a closed position.
Figure 4A:
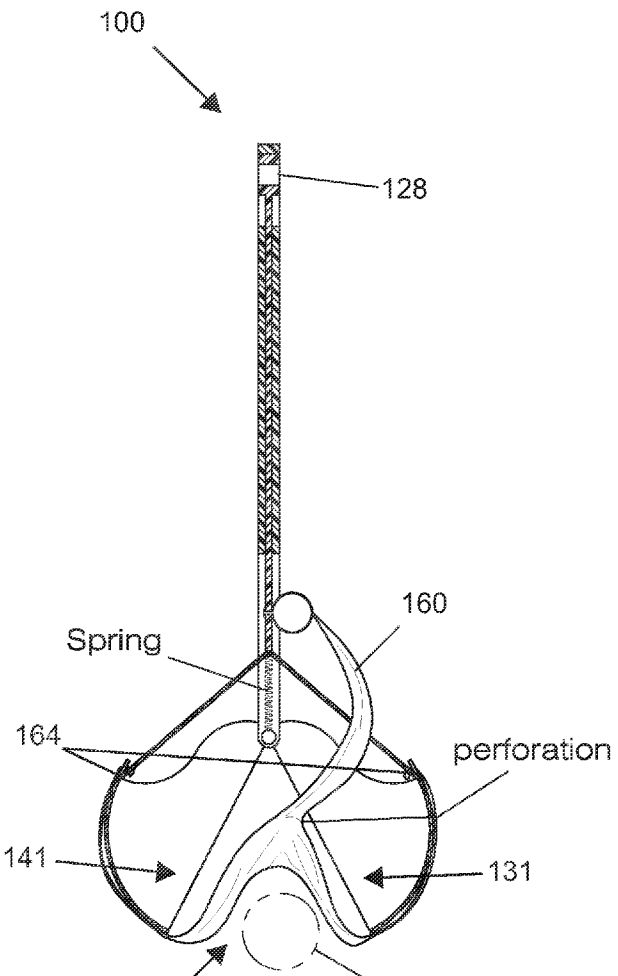
FIG. 4*a* shows a cross-sectional view of the present invention in a sagittal plane in an open position.
Figure 5:
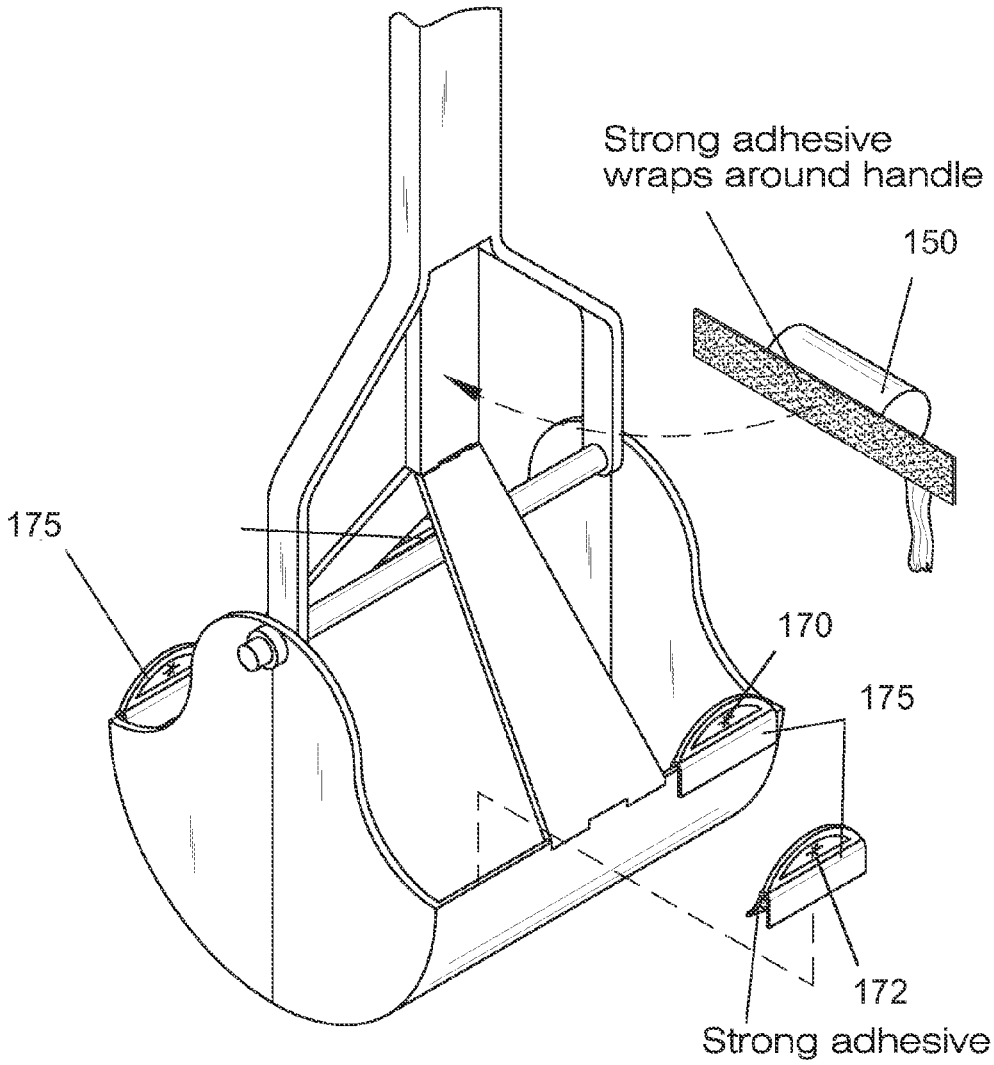
FIG. 5 shows a perspective view of the present invention in a kit form.
Figure 6:
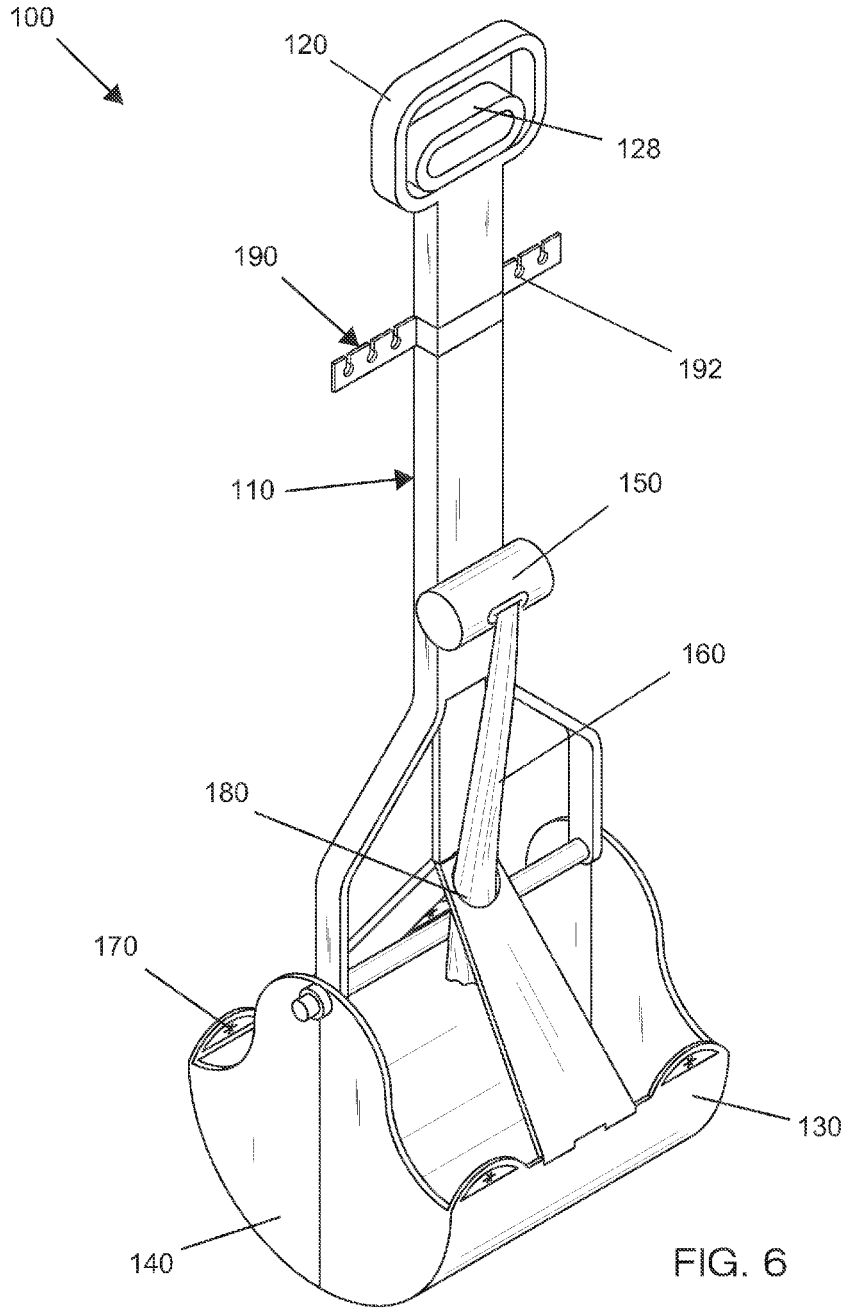
FIG. 6 shows a perspective view of an alternate embodiment of the present invention.

Following is a list of elements corresponding to a particular element referred to herein:

100 Pet feces retrieval system
110 Feces scoop
112 Scoop inner surface
120 Handle
122 Handle first end
124 Handle second end
126 Handle midpoint
128 Lever
130 First scooping jaw
131 First jaw anterior opening
132 First jaw posterior opening
133 First jaw wall
135 First jaw anterior lip
137 First jaw posterior lip
139 First jaw outer surface
140 Second scooping jaw
141 Second jaw anterior opening
142 Second jaw posterior opening
143 Second jaw wall
145 Second jaw anterior lip
147 Second jaw posterior lip
149 Second jaw outer surface
150 Bag dispenser
152 Bag roll
160 Continuous feed through bag
162 Opening
164 Upper lip
170 Eyelet
172 Eyelet inner periphery
175 Eyelet tab
180 Bag aperture
190 Filled bag holder
192 Filled bag holder notch Referring now to FIG. 1-6, the present invention features a sanitary pet feces retrieval system (100) having a disposable liner. In some embodiments, the system (100) comprises a feces scoop (110) having an elongated handle (120), a first scooping jaw (130) pivotally located on a handle second end (124), and a mated and opposing second scooping jaw (140) pivotally located on the handle second end (124).

In some embodiments, the first scooping jaw (130) comprises a cupped shape having a first jaw anterior opening (131), a first jaw posterior opening (132), and a curved first jaw wall (133). In some embodiments, the first jaw anterior opening (131) comprises a first jaw anterior lip (135) located around a first jaw anterior opening outer periphery and a first jaw posterior lip (137) located around a first jaw posterior opening (132).

In some embodiments, the second scooping jaw (140) comprises a cupped shape having a second jaw anterior opening (141), a second jaw posterior opening (142), and a curved second jaw wall (143). In some embodiments, the second jaw anterior opening (141) comprises a second jaw anterior lip (145) located around a second jaw anterior opening outer periphery and a second jaw posterior lip (147) located around a second jaw posterior opening (142).

In some embodiments, the first jaw anterior lip (135) interfaces with the second jaw anterior lip (145) in a first closed position to form a semi-cylindrical scoop inner surface (112)

to carry feces. In some embodiments, the first jaw anterior lip (135) and the second jaw anterior lip (145) have teeth or serrated edges. In some embodiments, the first jaw anterior lip (135) and the second jaw anterior lip (145) comprises a shape of a rectangle.

In some embodiments, a lever (128) is located on a handle first end (122). In some embodiments, the lever (128) is operatively connected to the first scooping jaw (130) and the second scooping jaw (140) to pivot the first scooping jaw (130) away from the second scooping jaw (140) into a second open position for retrieving feces from a ground surface via scooping.

In some embodiments, the system (100) comprises a bag dispenser (150) located on the handle (120) close to the handle second end (124). In some embodiments, the handle (120) is 32-36 inches in length.

In some embodiments, the system (100) comprises a disposable continuous feed through bag (160) having an opening (162) and an upper lip (164) located around the opening (162). In some embodiments, a plurality of continuous feed through bags (160) is sequentially located forming a bag roll (152) having the opening (162) of a first continuous feed through bag (160) positioned as a most outward portion of the bag roll (152). In some embodiments, the continuous feed through bags (160) are biodegradable.

In some embodiments, the continuous feed through bag (160) fully covers the scoop inner surface (112) and wraps around and fully covers a first jaw outer surface (139) and a second jaw outer surface (149). In some embodiments, the bag upper lip (164) is located at the first jaw posterior opening (132) via attachment to a plurality of first jaw eyelets (170) located on the first jaw posterior lip (137). In some embodiments, the bag upper lip (164) is located at the second jaw posterior opening (142) via attachment to a plurality of second jaw eyelets (170) located on the second jaw posterior lip (147).

In some embodiments, the scoop is pivoted from a first position to a second position for retrieving feces from the ground surface. In some embodiments, the scoop is pivoted to a second position for carrying feces in the continuous feed through bag (160) located over the first scooping jaw (130) and the second scooping jaw (140). In some embodiments, the continuous feed through bag (160) is removed from the first jaw eyelets (170) and the second jaw eyelets (170) for disposal of the continuous feed through bag (160) and the feces.

In some embodiments, the continuous feed through bags of the bag roll (152) pass through a bag aperture (180) located on the first jaw wall (133).

In some embodiments, the eyelet (170) comprises a plurality of projections located around an eyelet inner periphery (172) thereon for removable attaching to the upper lip (164).

in some embodiments, a filled bag holder (190) is perpendicularly located on the handle (120) between the handle first end (122) and a handle midpoint (126) for attaching the continuous feed through bag (160) thereto after use. In some embodiments, the filled bag holder (190) comprises a plurality of filled bag holder notches (192) for holding a plurality of continuous feed through bags (160) after use.

In some embodiments, the system comprises a kit for adapting to an existing feces scoop (110). In some embodiments, the kit comprises: a bag dispenser (150) for mounting on the handle (120) of the feces scoop (110), a bag roll (152) for mounting in the bag dispenser (150), and a plurality of eyelet tabs (175) having eyelets (170) located therein for mounting onto the first scooping jaw (130) and the second scooping jaw (140). In some embodiments, the kit comprises an attachable filled bag holder (190).

In some embodiments, the system (100) comprises an attachable bag dispenser (150). In some embodiments, the bag dispenser (150) is cylindrical. In some embodiments, the bag dispenser (150) can be attached to any existing pooper scooper. In some embodiments, the attachable component on the bag dispenser (150) or the filled bag holder (190) can be made with a heavy duty tape, a hook and loop system, or any winch-type component.

In some embodiments, the continuous feed through bag (160) is about 14"×14" and biodegradable. In some embodiments, the continuous feed through bag (160) is a continuous feed thru bag (160) that opens out to wrap up and around any style of pooper scooper's pick up component head. In some embodiments, the continuous feed through bags (160) are designed with open end feeding through first. In some embodiments, the continuous feed through bag (160) size is 14"×14" to ensure it will wrap up, over and around any size poop scoop head component. In some embodiments, the continuous feed through bags (160) are rolled together to allow a continuous feed. In some embodiments, the continuous feed through bags (160) are marked as to where it should stop, and where it should be inserted. The continuous feed through bags (160) will separate as needed via perforations and can be tied, for disposal of feces after use.

In some embodiments, the eyelet (170) is half-moon shaped on top, and is square on the bottom. In some embodiments, the eyelet (170) is made with a heavy duty plastic. In some embodiments, the half-moon holds a flexible yet sturdy inner rubbery-type plastic that the continuous feed through bag (160) corners attach into. The eyelets (170) attach to the top 4 corners of any existing pooper scooper with a heavy duty adhesive.

In some embodiments, the continuous feed through bag (160) is only open on the top and is sealed at the bottom. In some embodiments, the top of the continuous feed through bag (160) is tied off to fully seal off and enclose the contents.

As used herein, the term "about" refers to plus or minus 10% of the referenced number.

The disclosures of the following U.S. Patents are incorporated in their entirety by reference herein: U.S. Pat. No. D 263,512; U.S. Patent Pub. No. 2012/0104780; U.S. Patent Pub. No. 2011/0272955; U.S. Patent Pub. No. 2011/0057464; U.S. Patent Pub. No. 2008/0265592; U.S. Pat. No. 7,992,907; U.S. Pat. No. 7,854,455; U.S. Pat. No. 5,503,442; and U.S. Pat. No. 4,878,703.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A sanitary pet feces retrieval system (100) having a disposable liner, wherein the system (100) comprises:

(a) a feces scoop (110) having an elongated handle (120), a first scooping jaw (130) pivotally disposed on a handle second end (124), and a mated and opposing second scooping jaw (140) pivotally disposed on the handle second end (124), wherein the first scooping jaw (130) comprises a cup-shape having a first jaw anterior opening (131), a first jaw posterior opening (132), and a curved first jaw wall (133), wherein the first jaw anterior opening (131) comprises a first jaw anterior lip (135) disposed around a first jaw anterior opening outer periphery and a first jaw posterior lip (137) disposed around the first jaw posterior opening (132), wherein the first jaw wall (133) comprises a bag aperture (180) disposed therein, wherein the second scooping jaw (140) comprises a cup-shape having a second jaw anterior opening (141), a second jaw posterior opening (142), and a curved second jaw wall (143), wherein the second jaw anterior opening (141) comprises a second jaw anterior lip (145) disposed around a second jaw anterior opening outer periphery and a second jaw posterior lip (147) disposed around the second jaw posterior opening (142), wherein the first jaw anterior lip (135) interfaces with the second jaw anterior lip (145) in a first closed position to form a semi-cylindrical scoop inner surface (112) to carry feces, wherein a lever (128) is disposed on a handle first end (122), wherein the lever (128) is operatively connected to the first scooping jaw (130) and the second scooping jaw (140) to pivot the first scooping jaw (130) away from the second scooping jaw (140) into a second open position for retrieving feces from a ground surface via scooping;

(b) a bag dispenser (150) disposed on the handle (120) proximal to the handle second end (124); and (c) a disposable continuous feed through bag (160) having an opening (162) and an upper lip (164) disposed around the opening (162), wherein a plurality of continuous feed through bags (160) is sequentially disposed on a bag roll (152) having the opening (162) positioned as a most outward portion of the bag roll (152), wherein the continuous feed through bags (160) of the bag roll (152) pass through the bag aperture (180), wherein the continuous feed through bag (160) fully covers the scoop inner surface (112) and wraps around and fully covers a first jaw outer surface (139) and a second jaw outer surface (149), wherein the bag upper lip (164) is removably disposed at the first jaw posterior opening (132) via attachment to a plurality of first jaw eyelets (170) disposed on the first jaw posterior lip (137), wherein the bag upper lip (164) is removably disposed at the second jaw posterior opening (142) via attachment to a plurality of second jaw eyelets (170) disposed on the second jaw posterior lip (147), wherein the feces scoop (110) is pivoted from a first position to a second position for retrieving feces from the ground surface, wherein the feces scoop (110) is pivoted to a second position for carrying feces in the continuous feed through bag (160) disposed over the first scooping jaw (130) and the second scooping jaw (140), wherein the continuous feed through bag (160) is removed from the first jaw eyelets (170) and the second jaw eyelets (170) for disposal of the continuous feed through bag (160) and the feces.

2. The system (100) of claim 1, wherein the eyelet (170) comprises a plurality of projections disposed around an eyelet inner periphery (172) thereon for removable attaching to the upper lip (164).

3. The system (100) of claim 1, wherein a filled bag holder (190) is perpendicularly disposed on the handle (120) between the handle first end (122) and a handle midpoint (126) for attaching the continuous feed through bag (160) thereto after use, wherein the filled bag holder (190) comprises a plurality of filled bag holder notches (192) for holding a plurality of continuous feed through bags (160) after use.

4. The system (100) of claim 1, wherein a plurality of continuous feed through bags (160) is continuously disposed on a bag roll (152), wherein the continuous feed through bags are biodegradable, wherein the continuous feed through bags are about 14'×14'.

5. A kit for adapting an existing feces scoop into a sanitary pet feces retrieval system (100) having a disposable liner, wherein the kit (100) comprises:

(a) a feces scoop (110) having an elongated handle (120), a first scooping jaw (130) pivotally disposed on a handle second end (124), and a mated and opposing second scooping jaw (140) pivotally disposed on the handle second end (124), wherein the first scooping jaw (130) comprises a cup-shape having a first jaw anterior opening (131), a first jaw posterior opening (132), and a curved first jaw wall (133), wherein the first jaw anterior opening (131) comprises a first jaw anterior lip (135) disposed around a first jaw anterior opening outer periphery and a first jaw posterior lip (137) disposed around the first jaw posterior opening (132), wherein the first jaw wall (133) comprises a bag aperture (180) disposed therein, wherein the second scooping jaw (140) comprises a cup-shape having a second jaw anterior opening (141), a second jaw posterior opening (142), and a curved second jaw wall (143), wherein the second jaw anterior opening (141) comprises a second jaw anterior lip (145) disposed around a second jaw anterior opening outer periphery and a second jaw posterior lip (147) disposed around the second jaw posterior opening (142), wherein the first jaw anterior lip (135) interfaces with the second jaw anterior lip (145) in a first closed position to form a semi-cylindrical scoop inner surface (112) to carry feces, wherein a lever (128) is disposed on a handle first end (122), wherein the lever (128) is operatively connected to the first scooping jaw (130) and the second scooping jaw (140) to pivot the first scooping jaw (130) away from the second scooping jaw (140) into a second open position for retrieving feces from a ground surface via scooping;

(b) a bag dispenser (150), wherein the bag dispenser is designed to be disposed on and attached to the handle (120) proximal to the handle second end (124); and (c) a disposable continuous feed through bag (160) having an opening (162) and an upper lip (164) disposed around the opening (162), wherein a plurality of continuous feed through bags (160) is sequentially disposed on a bag roll (152) having the opening (162) positioned as a most outward portion of the bag roll (152) resulting in a series of continuous feed through bags (160) connected via perforations;

(d) a plurality of eyelet tabs (175) having eyelets (170) located therein for mounting onto the first scooping jaw (130) and the second scooping jaw (140), wherein the eyelet tabs (175) attach to any existing feces scoop via a heavy duty adhesive; and (e) a filled bag holder (190), wherein the filled bag holder is designed to be perpendicularly disposed on the handle (120) between the handle first end (122) and a handle midpoint (126) for attaching the continuous feed through bag (160) thereto after use, wherein the filled bag holder (190) comprises a plurality of filled bag holder notches (192) for holding a plurality of continuous feed through bags (160) after use; wherein the continuous feed through bag (160) fully covers the scoop inner surface (112) and wraps around and fully covers a first jaw outer surface (139) and a second jaw outer surface (149), wherein the bag upper lip (164) is removably disposed at the first jaw posterior opening (132) via attachment to a plurality of first jaw eyelets (170) disposed on the first jaw posterior lip (137), wherein the bag upper lip (164) is removably disposed at the second jaw posterior opening (142) via attachment to a plurality of second jaw eyelets (170) disposed on the second jaw posterior lip (147), wherein the continuous feed through bag (160) is attached to the filled bag holder notch (192) after use.

* * * * *